United States Patent [19]

Weigert

[11] 4,157,689

[45] Jun. 12, 1979

[54] MOVEABLE MOUNTING FOR SEWING MACHINE BINDER

[75] Inventor: Karl Weigert, Englishtown, N.J.

[73] Assignee: Reliable Attachment Company, New York, N.Y.

[21] Appl. No.: 834,499

[22] Filed: Sep. 19, 1977

[51] Int. Cl.[2] ..... D05B 35/00

[52] U.S. Cl. ..... 112/137; 112/121.26; 112/262.3

[58] Field of Search ..... 112/137, 152, 138, 121.26, 112/139, 141, 143, 147, 50, 262

[56] References Cited

U.S. PATENT DOCUMENTS

| | | | |
|---|---|---|---|
| 2,841,105 | 7/1958 | Bacher | 112/152 X |
| 2,962,988 | 12/1960 | Pons | 112/121.26 |
| 3,011,460 | 12/1961 | Haff, Jr. | 112/121.26 X |
| 3,335,683 | 8/1967 | Williams et al. | 112/137 |
| 3,736,892 | 6/1973 | Gray | 112/141 |
| 3,747,544 | 7/1973 | Nicolay et al. | 112/137 X |
| 3,847,096 | 11/1974 | Albrecht et al. | 112/152 X |
| 3,922,978 | 12/1975 | Smith | 112/147 |

FOREIGN PATENT DOCUMENTS

| | | | |
|---|---|---|---|
| 2607235 | 8/1977 | Fed. Rep. of Germany | 112/121.26 |

*Primary Examiner*—Werner H. Schroeder
*Assistant Examiner*—Andrew M. Falik
*Attorney, Agent, or Firm*—Breed, Stairs & Handal

[57] ABSTRACT

An apparatus for the feeding of an attachment-formed strip of fabric into a sewing machine of the type which intermittently advances a material to be sewn through the machine is disclosed. The apparatus comprises an eccentric mounted on the sewing machine for converting rotary motion to eccentric motion. Coupling structure couples the eccentric to the source of rotary power driving the sewing machine. A support structure supports a sewing machine attachment in a position where the output of the attachment may be fed into the sewing machine. Mounting moveably supports the support means on the sewing machine. A second coupling structure couples the support structure to the eccentric to impart a reciprocating motion to the support and to the attachment mounted on it.

In accordance with the disclosed method of automatically sewing a formed fabric strip to a base fabric with a sewing machine which intermittently advances the fabric through the machine, the strip is passed through an attachment having a plurality of surfaces for deflecting and forming the strip into a desired configuration. The attachment is then advanced toward the needle of the sewing machine as the fabric is being advanced through the machine. The attachment is then pulled away from the needle while the fabric is being held stationary in the sewing machine to pass an additional length of the strip through the attachment.

8 Claims, 9 Drawing Figures

MOVEABLE MOUNTING FOR SEWING MACHINE BINDER

BACKGROUND OF THE INVENTION

A common step in the fabrication of garments and other related products is the sewing of a binding or facing to a fabric. A binding may thus be sewn to the edge of a tablecloth or bedspread, the hem of a dress or an apron. In its most traditional form, binding or other related operations are performed by a sewing machine operator who feeds the edge of the textile material and a strip of material into the machine simultaneously while forming the strip in such a manner that it is sewn to the textile with the desired configuration.

Naturally, performance of this operation demands the services of a highly skilled sewing machine operator. In an attempt to provide an alternative, a number of attachments have been designed for automatically feeding a strip or ribbon into a sewing machne in such a manner that the strip is properly sewn to the base fabric. Such devices may be employed for a wide variety of purposes including a number of binding, folding and facing applications. One such device is disclosed in my U.S. Pat. No. 3,495,559. Generally, these devices have a number of guide surfaces which form the strip as it is drawn through the attachment. The strip is formed by the surfaces of the attachment which bear against and deflect it into the desired configuration for sewing.

Naturally, when the strip bears against the guide surfaces as it is drawn through the attachment, it experiences a certain amount of friction and is put under tension. Because many fabric strips tend to stretch under tension, the friction in the attachment causes them to be sewn to the fabric in a stretched condition. At the same time, the fabric is fed into the sewing machine in an unstretched condition. Thus, when the fabric with the fabric strip sewn to it leaves the machine, the binder tends to relax, thus puckering the base fabric.

In the past, the only answer to this problem was to use a strip which did not experience any significant stretching when fed through a binder or other attachment. This result could be achieved by using either a strip with a small coefficient of friction or one which is substantially inelastic. Naturally, the problems with regard to the puckering of a fabric are experienced in operations other than binding, including facing. The present invention allows such operations to be performed without puckering the fabric.

SUMMARY OF THE INVENTION

In accordance with the present invention, an apparatus for the feeding of an attachment-formed strip into a sewing machine of the type which intermittently advances a material to be sewn through the machine is provided. The apparatus comprises eccentric means mounted on the sewing machine for converting rotary motion to eccentric motion. Means are provided for coupling the eccentric means to the source of rotary power driving the sewing machine. Support means adapted to support a sewing machine attachment in a position where the output of the attachment may be fed into the sewing machine is provided. Mounting means are provided for moveably mounting the support means on the sewing machine. A second coupling means for coupling the support means to the eccentric means inparts a reciprocating motion to the support means and the attachment mounted on it.

In accordance with the method of the present invention, a formed strip is automatically sewn to a fabric using a sewing machine where the fabric is intermittently advanced through the machine. The strip is passed through an attachment having a plurality of surfaces for deflecting and forming the strip into a desired configuration. The attachment is advanced toward the needle of the sewing machine as the fabric is being advanced through the machine. The attachment is pulled away from the needle while the fabric is being held stationary in the sewing machine to pass an additional length of the strip through the attachment.

DETAILED DESCRIPTION OF THE PREFERRED EMBODIMENTS

Figure 1:
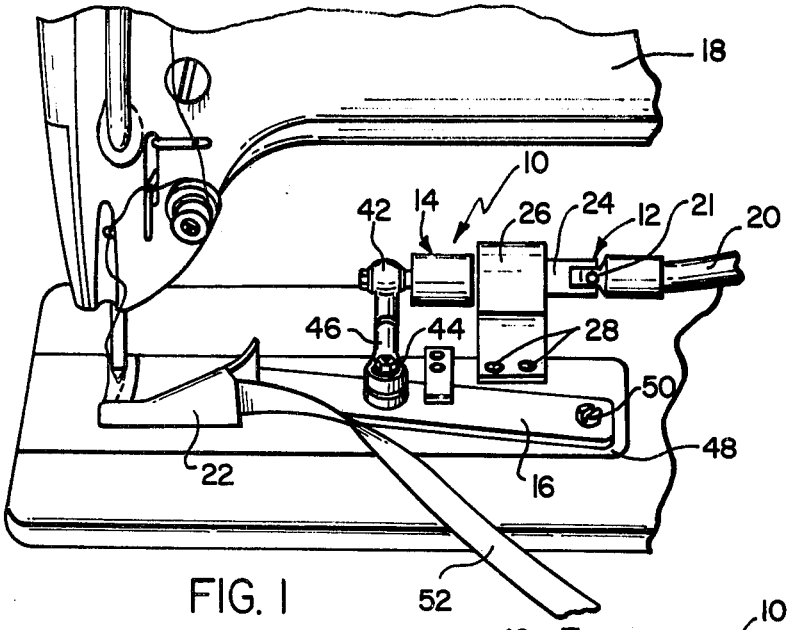
FIG. 1 is a perspective view of the inventive attachment mounting in place on a sewing machine.

Referring to FIG. 1, an embodiment of the inventive attachment mounting is illustrated. Generally, the mounting 10 comprises rotary motion coupling means 12, eccentric assembly 14, and moveably mounted support 16.

Naturally, the construction of the inventive attachment mounting will vary considerably depending upon the type of machine with which it is used. In a typical sewing machine 18, such as that illustrated in FIG. 1, one would couple a drive bar 20 to the source of rotary power which is driving the sewing machine. Thus, upon the application of power to the machine, drive bar 20 will rotate, thereby providing the inventive attachment mounting which is coupled to driver bar 20 by a universal joint 21. Inasmuch as it is desirable to maintain the position of the attachment 22, which is mounted on the inventive attachment mounting, constant relative to the positions of the various working components of the sewing machine as they cycle through their operation, it is desirable to couple drive bar 20 to the machine via a non-slipping coupling, such as a chain and toothed gear coupling or the like.

Figure 2:
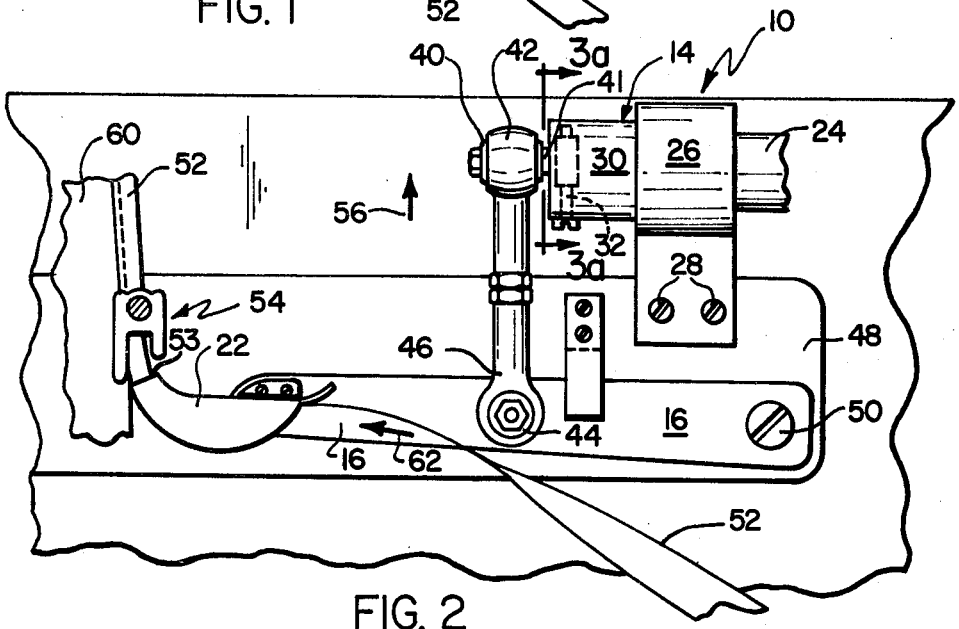
FIG. 2 is a plan view showing the inventive attachment mounting.
Figure 3A:
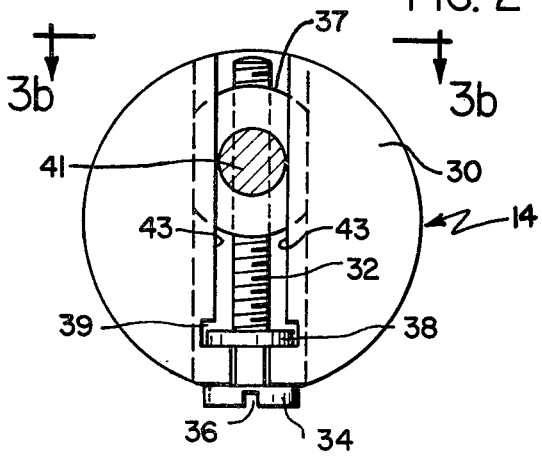
FIG. 3*a* is a view along line 3*a*—3*a* of FIG. 2 illustrating in detail a portion of the inventive sewing machine attachment and FIG. 3*b* is a view along line 3*b*—3*b* of FIG. 3*a;*

Drive bar 20 is coupled to rotatably mounted bar 24 via universal joint 21. Bar 24 is mounted on bearings contained within support 26. Support 26 is, in turn, held by screws 28 to the top surface of the sewing machine. Eccentric assembly 14 is mounted on the other end of rotatably mounted bar 24. As illustrated in FIG. 2, the eccentric assembly comprises an outer housing 30 within which a threaded support bar 32 is mounted (FIG. 3*a*). Threaded support 32 includes a head 34, which has a screwdriver receiving slot 36. Threaded support 32 is held in position by an annular ridge 38 which mates with groove 39.

A ball joint comprises a ball 40 which is mounted on a shaft 41 and a socket 42. The portion 37 of shaft 41 having a tapped hole is held in position by a pair of ridges 43 on housing 30. Shaft 41 has a tapped hole through which threaded bar 32 passes. The ball and socket assembly is in turn coupled to moveably mounted support 16 by a second assembly comprising a ball 44, which is secured to support 16, and a socket 46, which is coupled to socket 42. Support 16 is pivotably mounted on the top surface of the sewing machine 48 by being rotatably supported on a post 50 which is secured to surface 48. Finally, attachment 22 is secured to moveably mounted support 16 by any suitable means in such a position that a ribbon 52 entering the attachment is fed from the output 53 of the attachment towards the working area 54 of the machine.

Generally, most sewing machines operate by intermittently advancing a fabric to be sewn through the machine. This intermittent advancement is done by the generally eccentric reciprocating motion of a feed dog which cooperates with a foot on the sewing machine. The timing of the motion of these elements is synchronized with the needle's timing in such a way that stitches are sewn into the fabric. In accordance with the preferred embodiment of the present invention, the timing of the motion of the inventive attachment mounting is also synchronized to the motion of the feed dog. Accordingly, drive bar 20 is so coupled to the source of the machine's power to undergo one revolution for each cycle of the feed dog.

Each time the drive bar 20 undergoes one revolution, this one revolution is coupled to rotatably mounted bar 24 by universal joint 21. This in turn rotates eccentric assembly 14, imparting an eccentric motion to the ball and socket joints. This eccentric motion results in a reciprocating motion by moveably mounted support 16. The magnitude of this reciprocating motion depends upon the eccentricity of eccentric assembly 14 and this eccentricity may be adjusted by rotating threaded support 32 by engaging slot 36 on head 34 with a screwdriver and rotating the threaded support.

Generally, the coupling between drive bar 20 and the source of rotary power for the sewing machine is arranged in such a manner that while the fabric is being advanced into the machine, the ball and socket joints, and, accordingly, attachment 22, are advanced toward the working area 54 of the sewing machine in the direction indicated by arrow 56.

Figure 4:
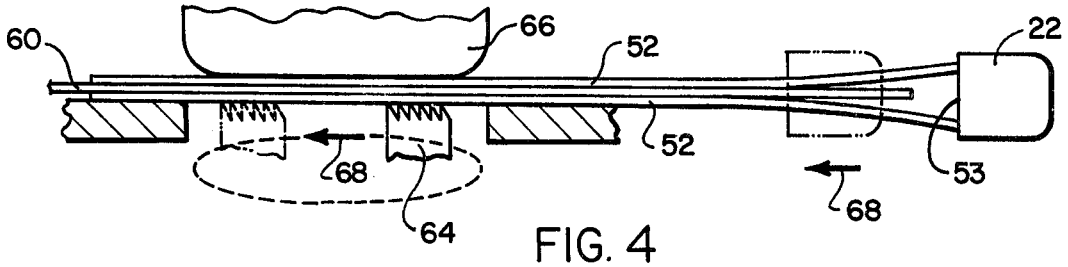
FIGS. 4–5 are schematic illustrations of successive steps in the operation of the inventive sewing machine attachment mounting.
Figure 5:
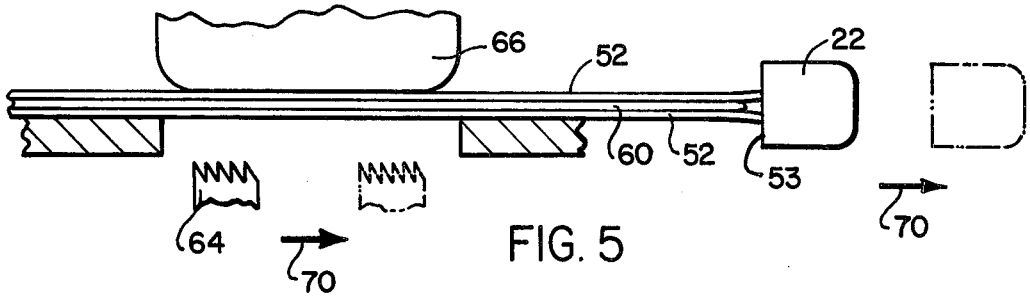
Figure 6:
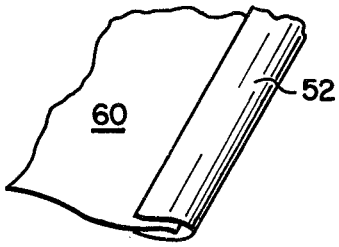
FIG. 6 is a schematic view of a fabric with a binder ribbon having a configuration which the operation illustrated in FIGS. 4–5 achieves.

The operation of a typicl attachment is illustrated schematically in FIGS. 4 and 5. As illustrated in FIG. 6, this attachment is of the type which sews a simple binder 52 to the edge of a fabric 60. Ribbon 52 enters the attachment moving in the direction indicated by arrow 62 (FIG. 2) and leaves the attachment formed with the desired profile. The ribbon binder 52 is fed together with fabric 60 into the needle of the sewing machine where it is sewn to the fabric keeping the same profile. At the commencement of the feeding part of the sewing machine cycle, feed dog 64 and attachment 22 are in the positions illustrated in solid lines in FIG. 4. A foot 66 bears against formed binder ribbon 52 and the edge of fabric 60. Feed dog 64 then advances to the position illustrated in phantom lines in FIG. 4. This motion is simultaneous with the advancement of the attachment 22 to the position illustrated in phantom lines in FIG. 4. Both motions occur in the direction indicated by arrows 68. In accordance with the present invention, this allows the ribbon 52 to be fed into the sewing machine without being dragged through the attachment. Thus, it is not subjected to tension. As a result, the ribbon is sewn to the fabric without tension as it is being fed into the sewing machine working area by the forward motion of attachment 22 while simultaneously the fabric is being fed into the machine by the operator.

After the advancing motion of the feed dog has been completed, the feed dog and attachment 22 go to the positions illustrated in solid lines in FIG. 5. After the feeding motion of the feed dog is completed moveable support 16 and attachment 22 begin to receed in the direction indicated by arrows 70. Inasmuch as the ribbon is being held by the foot 66, which bears against the ribbon and the fabric being sewn, ribbon is passed through the attachment and formed with the desired profile as the motion of the attachment continues to the position illustrated in phantom lines in FIG. 5. Simultaneous with this prefeeding operation, feed dog 64 is also advanced to the position illustrated in phantom lines in FIG. 5. The feed dog and attachment are then advanced to the position illustrated in solid lines in FIG. 4, and the cycle is repeated.

The inventive attachment mounting solves the problems associated with the stretching of a binder as it is pulled through a sewing machine attachment designed to give it a desired profile into which it is to be sewn. As noted above, the problem results from stretching of the binder ribbon. Inasmuch as the amount of stretch may vary depending upon the nature of the binder ribbon material, it may become necessary to either increase or decrease the displacement of the attachment between the positions illustrated in FIG. 5, prior to the advancement of material and binder into the sewing machine. For example, thick stretchable binder ribbons would require a greater amount of pre-feeding while relatively unstretchable binders having a low coefficient of friction could be fed into the sewing machine with only minimal prefeeding. The magnitude of the prefeeding operation may be adjusted to the proper value by simply rotating threaded support 32 to a position where sewing is done without puckering the binder or the fabric.

Figure 3B:
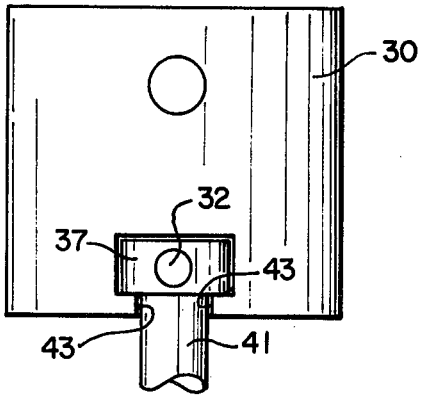
Figure 7:
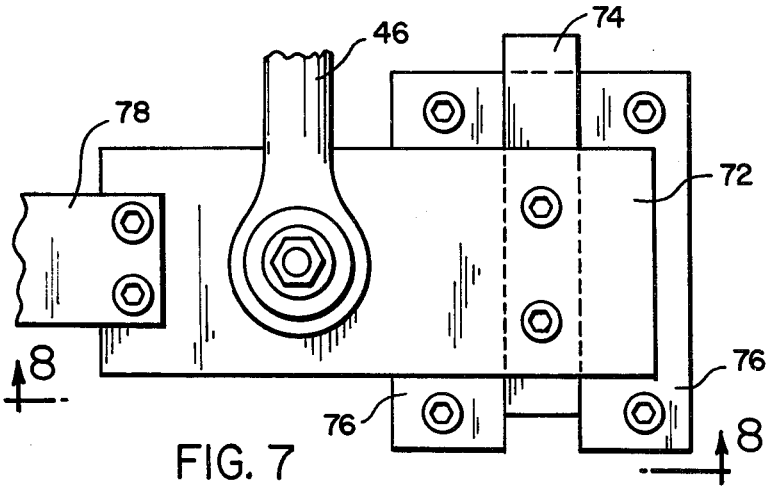
FIG. 7 is a plan view of a portion of an attachment mounting constructed in accordance with an alternative embodiment of the present invention.
Figure 8:
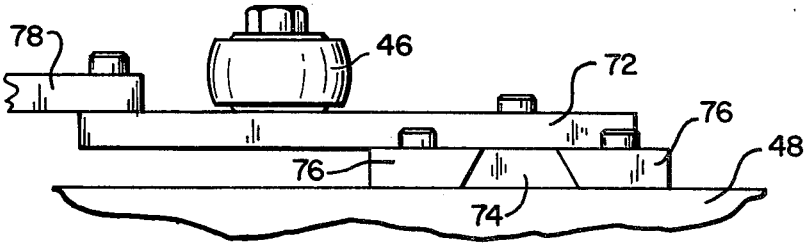
FIG. 8 is a view along line 8—8 of FIG. 7.

Because of the great diversity that exists between various sewing machines and sewing machine attachments, the present invention is likely to take the form of several embodiments. For example, the pivotal arrangement such as that illustrated in FIGS. 1–3 may be replaced with a sliding arrangement such as that illustrated in FIGS. 7–8. In this alternative embodiment of the invention, socket 46 is coupled to a plate 72. Plate 72 is in turn attached to slidable support 74, which slides between a pair of track members 76. Track members 76 are in turn secured to the top surface 48 of the sewing machine. A sewing machine attachment 78 is secured to plate 72. An eccentric drive system such as that illustrated in FIG. 2 drives plate 72. Reciprocating motion of plate 72 results in reciprocating movement of attachment 78.

While illustrative embodiments of the invention have been shown, it is of course understood that various modifications will be obvious to those of ordinary skill in the art. Such modifications are within the spirit and scope of the invention which is limited and defined only by the appended claimes.

I claim:

1. A method for automatically sewing a formed fabric strip to a base fabric with a sewing machine which intermittently advances the fabric through the machine, comprising the steps of:

(a) passing the strip through an attachment having a plurality of surfaces for deflecting and forming the strip into a desired configuration;

(b) advancing said attachment toward the needle of the sewing machine as said fabric is being advanced through said machine;

(c) pulling said attachment away from said needle while said fabric is being held stationary in said sewing machine to pass an additional length of said strip through said attachment.

2. Apparatus for the feeding of an attachment-formed strip of fabric into the needle of a sewing machine of the type which intermittently advances the material to be sewn into the sewing machine, comprising:

(a) reciprocating means for generating a reciprocating motion;

(b) support means adapted to support a sewing machine attachment at a position where the output of said attachment may be fed into said sewing machine;

(c) mounting means for moveably supporting said support means on said sewing machine; and (d) coupling means for coupling the output of said reciprocating means to said attachment to impart a reciprocating motion to the support means and said attachment mounted on it, said reciprocating means generating a motion which when coupled to said support means acts to move said support means away from the needle of the sewing machine when the material to be sewn is not being advanced toward the needle of the sewing machine to draw a length of said strip through said attachment.

3. Apparatus for the feeding of an attachment-formed strip of fabric into the needle of a sewing machine of the type which intermittently advances the material to be sewn into the sewing machine, comprising:

(a) eccentric means having an input and an output for converting rotary motion to eccentric motion;

(b) first coupling means for coupling the input of said eccentric means to a source of rotary power;

(c) support means adapted to support a sewing machine attachment at a position where the output of said attachment may be fed into said sewing machine;

(d) mounting means for moveably supporting said support means on said sewing machine; and (e) second coupling means for coupling the output of said eccentric means to said attachment to impart a reciprocating motion to the support means and the attachment mounted on it, said eccentric means being configured to move said attachment away from the needle of the sewing machine when the material to be sewn is not being advanced toward the needle of the sewing machine to draw a length of said strip through said attachment.

4. Apparatus as in claim 3, wherein said eccentric means is coupled to said source of rotary power in such a manner that it undergoes one revolution for each advancement of the material to be sewn into the sewing machine.

5. Apparatus as in claim 3, wherein said mounting means rotatably supports said support means.

6. Apparatus as in claim 3, wherein said mounting means slideably supports said support means.

7. Apparatus as in claim 3, wherein said second coupling means comprises at least one ball and socket joint.

8. Apparatus for the feeding of an attachment-formed strip of fabric into the needle of a sewing machine of the type which intermittently advances the material to be sewn into the sewing machine, comprising:

(a) eccentric means having an input and an output for converting rotary motion to eccentric motion, said eccentric meas comprising:

(i) a main body portion defining a guide track exending from the axis of rotation of the main body portion;

(ii) means for rotatably supporting said main body portion;

(iii) threaded support means mounted in said body portion;

(iv) a support body defining a tapped hole, said tapped hole mating with said threaded support means, and said support body being positioned, configured and dimensioned to be slideably mounted in said track and maintained in position by said threaded support means by being threadably mounted thereon and to have its position in the guide track of the main body portion adjusted by rotation of said threaded support means;

(v) input means for coupling rotary motion to said main body portion; and (vi) output means for coupling eccentric motion from said support body;

(b) first coupling means for coupling the input of said eccentric means to a source of rotary power;

(c) support means adapted to support a sewing machine attachment at a position where the output of said attachment may be fed into said sewing machine;

(d) mounting means for moveably supporting said support means on said sewing machine; and (e) second coupling means for coupling the output of said eccentric means to said attachment to impart a reciprocating motion to the support means and the attachment mounted on it.

* * * * *